United States Patent [19]

O'Brien et al.

[11] Patent Number: 4,597,684

[45] Date of Patent: Jul. 1, 1986

[54] PAINTING ROLLER ASSEMBLY

[75] Inventors: Lawrence B. O'Brien, Carmel; Walker A. Messick, Indianapolis, both of Ind.

[73] Assignee: Black & Decker Inc., Newark, Del.

[21] Appl. No.: 623,320

[22] Filed: Jun. 22, 1984

[51] Int. Cl.[4] ..... B05C 17/02

[52] U.S. Cl. ..... 401/197; 401/188 R; 15/230.11

[58] Field of Search ..... 401/21, 22, 197, 188 R, 401/208; 15/230.11

[56] References Cited

U.S. PATENT DOCUMENTS

| | | | |
|---|---|---|---|
| Re. 29,311 | 7/1977 | Ritter | 401/188 R |
| 860,078 | 7/1907 | Binks | 401/197 X |
| 2,467,010 | 4/1949 | Coley | 401/218 |
| 2,606,334 | 8/1952 | Vaden et al. | 401/197 X |
| 2,684,497 | 7/1954 | Graham | 401/197 |
| 2,743,469 | 5/1956 | Ditch | 401/197 |
| 2,778,046 | 1/1957 | Fisher | 15/503 |
| 2,882,541 | 4/1959 | Easley | 15/230.11 |
| 2,965,911 | 12/1960 | Hempel et al. | 15/230.11 X |
| 3,134,130 | 5/1964 | Chadwick, II | 401/197 |
| 3,230,570 | 1/1966 | Flippen | 15/230.11 X |
| 3,231,151 | 1/1966 | Clark et al. | 401/172 X |
| 3,436,161 | 4/1969 | Charos | 401/197 |
| 3,457,017 | 7/1969 | Bastian | 401/197 |
| 3,539,268 | 11/1970 | Stebbins | 401/197 |
| 3,549,267 | 12/1970 | Wurzer et al. | 401/197 |
| 3,554,659 | 1/1971 | Stokes | 15/230.11 |
| 3,776,645 | 12/1973 | Walker | 401/188 |
| 3,826,581 | 7/1974 | Henderson | 401/270 |
| 3,877,823 | 4/1975 | Leland | 401/197 |
| 3,933,415 | 1/1976 | Woolpert | 401/145 |
| 4,072,429 | 2/1978 | Terzian et al. | 401/146 |
| 4,231,668 | 11/1980 | Groth et al. | 401/146 |

FOREIGN PATENT DOCUMENTS

| | | | |
|---|---|---|---|
| 1003948 | 11/1949 | France | 401/208 |

*Primary Examiner*—Richard J. Apley
*Assistant Examiner*—Alfedo Acoff
*Attorney, Agent, or Firm*—Ronald B. Sherer; Edward D. Murphy; Harold Weinstein

[57] ABSTRACT

Described briefly, according to a typical embodiment of the invention, a roller has a core comprising plurality of relatively hard and rigid segments fastened together in a stack and rotatably mounted to a shaft. The roller core has internal baffled passageways established by grooves in abutting faces of segments, so that, when paint is supplied to a cavity in the center of the stack, it will depart through these passageways in the roller in a controlled manner. A replaceable sock-like cover is received on the roller stack and secured by end retainers. The roller can be easily and completely disassembled for cleaning.

32 Claims, 8 Drawing Figures

PAINTING ROLLER ASSEMBLY

BACKGROUND OF THE INVENTION

1. Field of the Invention

This invention relates generally to painting rollers, and more particularly to a roller having internal feed features useful with a pressurized supply.

2. Description of the Prior Art

Rollers for applying paint and other coating materials have been used for many years. Those most commonly used are dipped in paint (usually in a roller tray) and then applied to a wall or other surface to be coated.

Considerable effort have been directed toward rollers which need not be dipped. Some systems apply paint to the outside of the roller, otherwise than by dipping. Examples are found in United States Patents as follows: U.S. Pat. Nos. 3,549,267, issued to Wurzer et al. on Dec. 22, 1970, and 4,072,429, issued to Terzian et al. on Feb. 7, 1978. An example is also shown in FIG. 8 of the Ritter patent mentioned below. It seems that most of the patents which have resulted from efforts to avoid dipping, disclose internally fed rollers. Examples are found in the following United States patents:

| U.S. Pat. No. | Inventor | Date Issued |
|---|---|---|
| 2,743,469 | Ditch | 5/01/56 |
| 2,882,541 | Easley | 4/21/59 |
| 3,231,151 | Clark et al. | 1/25/66 |
| 3,457,017 | Bastian | 7/22/69 |
| 3,879,140 | Ritter | 4/22/75 |
| 3,933,415 | Woolpert | 1/20/76 |

The Ditch patent discloses a paint roller internally supplied through the handle tube. O-rings 16 mounted in the hubs 15 of the roller, seal the hubs to the tube.

The Easley roller is supplied through a roller mounting tube and through radially extending apertures in a wood, non-absorbent roller core. The pair is supplied to a roller cover made of wool or other material. The roller mounting tube is connected to a pressurized paint source. O-ring 23 in bearing sleeve 19 prevents leakage of paint outward between the bearings and tube.

The Clark et al. patent FIG. 3 discloses the use of a non-absorbent sleeve 74 mounted to the handle. It serves to occupy space in the roller and radially distribute paint from the handle tube or "conduit portion" 72. This is an effort to address the problem encountered in some prior art rollers where there is so much paint contained in the roller that the paint cannot be controlled by the cover and drips after the paint supply is shut off. The extra paint is also very heavy and tiresome for the operator to use. Such a problem might exist in the roller of FIG. 2 of the Ritter patent.

In the Woolpert patent, there are roller-type paint applicators in FIGS. 7, 8 and 9, the latter showing an edger in contrast to the cylindrical rollers of FIGS. 7 and 8. In FIG. 8, there is shown a sponge roller 114 with a fitted fabric sleeve cover 130, all of which is mounted over a foraminous tube 110.

Some additional prior art specifically related to internally fed rollers, includes United States Patents the following:

| U.S. Pat. No. | Inventor | Date Issued |
|---|---|---|
| 860,078 | Binks | 7/16/07 |

-continued

| U.S. Pat. No. | Inventor | Date Issued |
|---|---|---|
| 2,606,334 | Vaden et al. | 8/12/52 |
| 2,965,911 | Hempel et al. | 12/27/60 |
| 3,134,130 | Chadwick II | 5/26/64 |
| 3,539,268 | Stebbins | 11/10/70 |
| 3,554,659 | Stokes | 1/12/71 |
| 3,776,645 | Walker | 12/04/73 |
| 3,826,581 | Henderson | 7/30/74 |
| 3,877,823 | Leland | 4/15/75 |
| Re. 29,311 | Ritter | 7/19/77 |

In the above patents, Binks provides a supply of paint to, and surplus removal from, the interior of a roller (FIG. 1), a pad (FIG. 3), and a brush (FIG. 5). Vaden discloses a plastic roller body with a sheepskin cover and a threaded nut securing the cover to the roller. It has a delivery control valve push button 16 on the handle.

Hempel et al. discloses a polyurethane stationary wiper core in a self-contained inking roller. Chadwick shows a belt-type roller.

The Stebbins patent discloses a roller having a paint supply tube with an aperture centered longitudinally of the roller. The roller also has annular chambers 50 and 52 within a perforated rigid sleeve of cardboard tube 28 to which the fibers 32 are affixed.

Strokes shows one or two internally fed rollers mounted to paint supply spindles.

Walker shows roller-type applicators in FIGS. 5, 6, 9, 10 and 11, and also various types of pad applicators including pointed pads. Henderson discloses a roller having a plurality of radial ports longitudinally spaced and circumferentially spaced on the cover base 21 to supply the pile 20 of the roller.

The Leland patent is one example of a fountain-type paint roller with a supply of paint carried in the roller itself. It is an interchangeable cartridge for a roller handle unit.

The Ritter patent is a reissue of the earlier one mentioned above.

The roller of the present application is different from the following in that it employs a stack of core segments and an unusual seal. There is a U.S. Pat. No. 3,230,570 issued Jan. 25, 1966 to Flippen. It uses a stack of annular foam-plastic members 112 to receive and apply paint to a surface such as a parking lot. Another type device using discs is a wet lime marker for athletic fields and the like shown in U.S. Pat. No. 2,778,046 issued Jan. 22, 1957 to A. L. Fisher.

SUMMARY OF THE INVENTION

The present invention is directed to providing a roller which contains a minimum quantity of paint and yet evenly distributes it, is relieable in operation, and easily disassembled for cleaning.

Described briefly, according to a typical embodiment of the invention, a roller has a plurality of relatively rigid segments fastened together in a stack and rotatably mounted to a shaft. The segments have external grooves in their radial faces which, when placed in juxtaposition with the adjacent segment, form baffled passageways. End seal means are provided so that, when paint is supplied to a cavity in the center of the stack, it will depart through passageways between segments of the roller in a controlled manner. A replaceable sock-like cover is received on the roller stack. The roller can be easily and completely disassembled for cleaning and seal replacement, if needed.

DETAILED BRIEF DESCRIPTION OF THE DRAWINGS

DESCRIPTION OF THE PREFERRED EMBODIMENT

Figure 1:
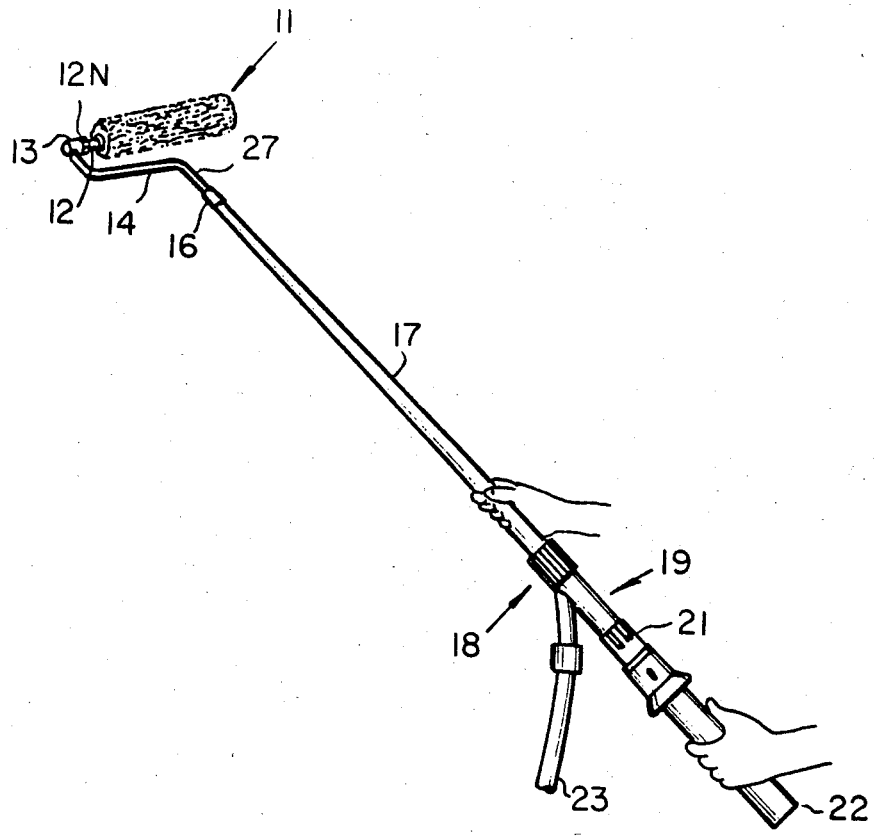
FIG. 1 is a pictorial, in-use, view of a paint roller assembly incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, in FIG. 1 there is a paint roller assembly 11 rotatably mounted on tube 12. Tube 12 has a nut 12N welded on the end which is threaded into the fitting 13. The fitting 13 is mounted at the end of a further tube 14 connected by coupling 16 to a handle extension 17 connected through a further coupling 18 to a swivel connector assembly 19 having a coupling 21 connected to the control handle 22. Paint is supplied under pressure from the hose 23 through the swivel coupling 19, tube 17, tube 14, fitting 13 and tube 12 to the interior of the roller. Apparatus for doing this is disclosed in a patent application of Lawrence B. O'Brien et al., Ser. No. 218,354, filed Dec. 22, 1980, a portion of which is now published in U.S. Pat. No. 4,424,011, issued Jan. 3, 1984.

Figure 2A:
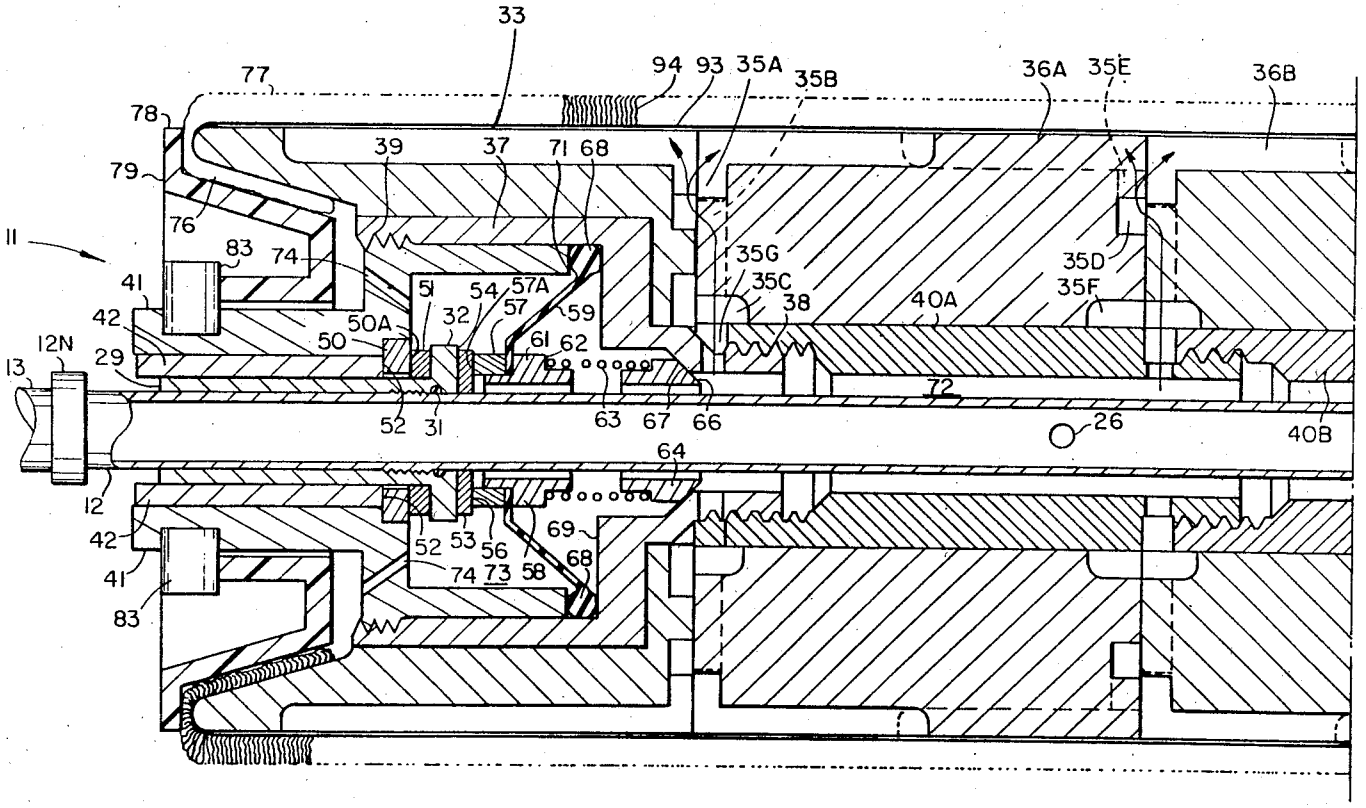
FIG. 2A–2B is a longitudinal sectional view through the roller assembly itself.
Figure 2B:
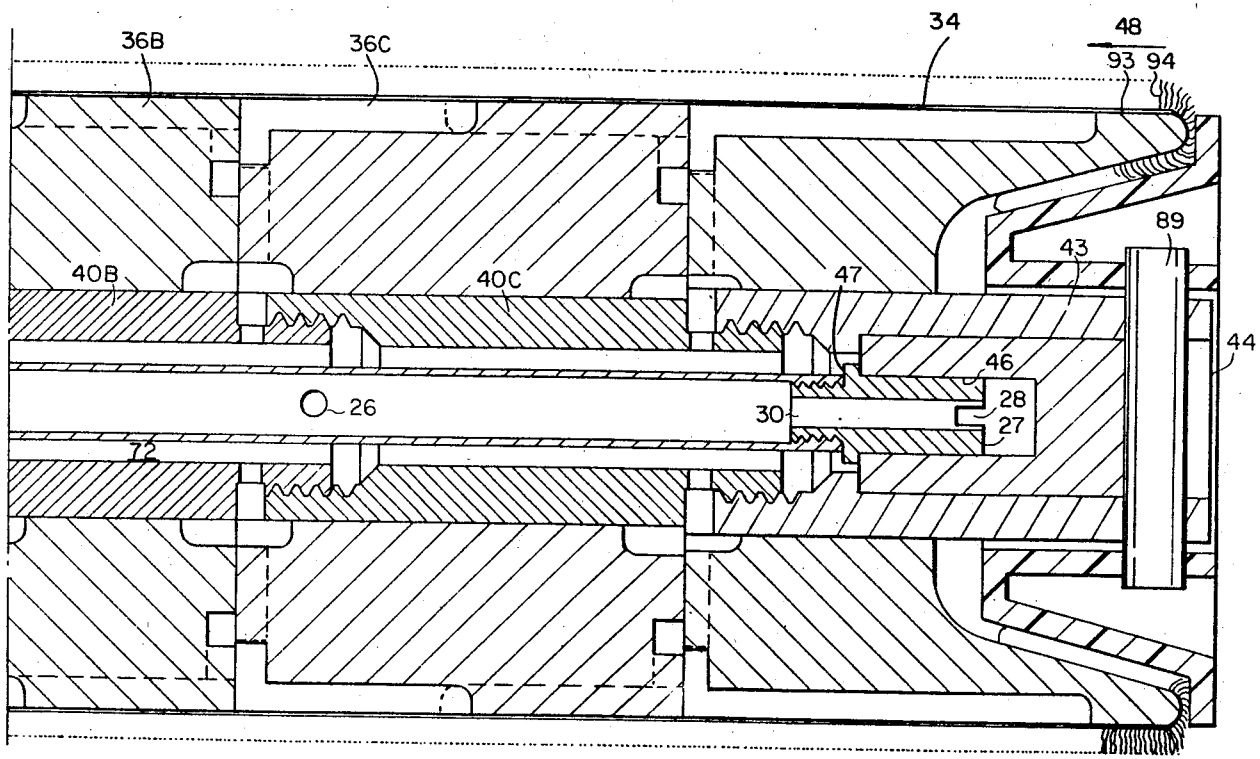

According to a typical embodiment of the present invention, and referring now to FIGS. 2A–2B, it can be seen that the handle tube 12 has two apertures 26 in the wall thereof. While the tube is shown in section, these apertures actually are drilled entirely through, resulting in four apertures in the wall. These dispense paint supplied from the hose 23. Tube 12 is a thick-walled tube and is internally threaded at its distal end. A retainer 27 is threaded into the distal end of tube 12 and, being threaded and having a screwdriver slot 28 therein, is removable for easy servicing of the seal elements, if desired. The retainer is drilled at 30 to allow flushing of paint from the tube 12 during cleaning.

A bushing 29 is secured to the tube 12 by threading onto the tube, and is sealed by an "O" ring 31. Alternatively it could be secured by a set screw received in the flange 32 of the bushing, or secured and sealted by cementing the tube.

The roller core comprises a stack of segments. Five are shown. More or less could be used. Two end segments are 33 and 34. Three intermediate segments 36A, 36B and 36C are identical to each other. The segments have paint delivery passageways such as 35A–35G therein. Starting with end segment 33, it is made of a solid polyurethane foam material, preferably of approximately a ten pound per cubic foot density. It is secured and sealed on a metal core 37, typically of aluminum or magnesium and which has a threaded boss 38 at its end which is screwed into core 40A of the next segment 36A, when the roller is assembled. The segment core 37 has internal threads at 39 at its opposite, outer end. The core 37 is thereby mounted and secured to the retaining nut/bearing member 41 having a bearing 42 secured therein. Member 41 may be made of aluminum while the bearing 42 is preferably made of a molybdenum impregnated nylon "6" material. A product known by the trade name "Nylatron GS" by Polypenco Polymer Corp. of Reading, Pa. can be used. This bearing 42 provides radial bearing support for one end of the roller assembly.

At the distal end of the tube 12, segment 34 is secured and sealed on a metal core member 43 having an end plug 44 therein with a bearing surface 46 therein rotatably received on the radial bearing surface of retainer 27. Although the surface 46 could be received directly on tube 12, the removable and replaceable retainer 27, avoids concern about wear on the tubing 12. The integral flange 47 on the retainer serves to retain on the tube, the seal element now to be described herein, so they cannot fall off the tube when the roller is disassembled. It also serves to provide a limit of axial movement of the roller assembly on the tube 12 in the direction of arrow 48 toward the proximal end. Since the distal end of the roller assembly is closed, there is no seal provision needed other than to be sure that the segment 34 and plug 44 are properly sealed by glue or otherwise to the core member 43.

The proximal end of the roller assembly is sealed by means which will now be described. A washer 51 is snugly and sealingly received on the bushing 29 and against one face of flange 32. It engages a thrust washer 50 which is snugly and sealingly received in member 41 at a recess in end 52 of bearing 42. This washer 50 should have a hard, wear resistant face 50A. It provides a running seal against washer 51 at this location.

Another washer 53 snugly and sealingly fits tube 12 and sealingly rests against the other face 54 of flange 32. Both washers 51 and 53 may be made of the same low friction, wear resistant material. One example is sold under the trade name "Rulon A" by Dixon Industries, Inc. of Clifton Heights, Pa. Glass filled "Teflon" can also be used for these washers. The flat face 56 of wahser 53 provides a running seal against a washer 57 which should also have a hard, wear resistant face 57A. Tungsten carbide has been found to be a suitable material for face 50A of washer 50 and face 57A of washer 57. This washer is secured to a ring 58. A diaphragm 59 is sandwiched between and sealed to washer 57 and one face of the flange 61 of the ring 58. The diaphragm can be made of any material and configuration which is paint resistant and allows free axial movement over a suitable range. Typical materials are rubber, Teflon and metal bellows allowing 0.125 inch axial movement. The other face 62 on flange 61 serves as a spring seat for spring 63. The other end of the spring is seated on the spring seat ring 64. The beveled end 66 of the spring seat ring engages the conical face 67 of the core member 37. Thereby, when segment 33 is screwed onto the member 41, a spring loaded seal is established between the carbide washer 57, the seal ring 53 and the flange 32 of bushing 29. The outer marginal portion of diaphram 59 is formed as thickened rim 68. The rim 68 is clamped between the face 69 of member 37 and the end 71 of member 41. Thereby the end of segment core 37 is sealed when segment 33 is screwed tight onto member 41. It is preferable that, when the roller is assembled, the load applied by spring 63 is five pounds. This is regardless of the area of the seal between washer 53 and ring 57. It has been found that a three pound load is not sufficient to provide the desired sealing function, whereas a seven pound load raises the rotational friction more then desired. Therefore, the paint which is pressurized and in the chamber 72 along the outside of tube 12 and inside the segments of the roller core is prevented from getting out along shaft 12 or otherwise out through the end of the roller. If any seepage occurs past the seal face 56-57, into the chamber 73, the chamber is open to the outside by means of a pessure relief passage 74. In this way, pressure cannot build-up in the chamber 73 and force paint out between bushing 29 and bearing 42. Instead, it will go out toward and be absorbed in the in-fold end 76 of the flexible, sock-like roller cover 77 which is sandwiched between the end of segment 33 and flange 78 of the cover-locking retainer 79. It is possible, through the proper choice of materials and shape of diaphram 59, for the diaphram, when deflected, to apply the necessary sealing force without a separate helical spring. This can be accomplished by molding a spring into a rubber diaphram or constructing a diaphram of metal in a corrugated or bellows shape.

Figure 5:
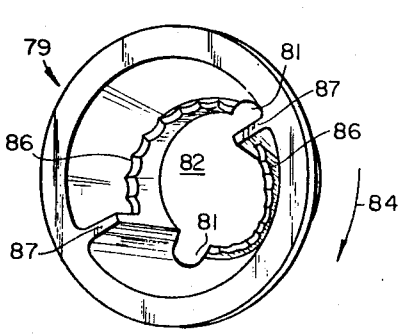
FIG. 5 is a pictorial view of one of the sleeve retainers.

The cover retainer is shown pictorially in FIG. 5. It has two slots 81 projecting radially outward from the central aperture 82 therein. Then enable this retainer to be pushed in over the cylindrical pins 83 which are secured in the member 41. Then, by rotating the retainer in the clockwise direction 84, these pins will become engaged with the serrated cam ramps 86. The finger tabs 87 make it easy to turn the retainer clockwise sufficiently to obtain the desired tightness of the cover on the end of segment 33. This adjustment will be maintained by the pins 83 being received in the corresponding notches in the notched ramps. The same construction is provided at the opposite end of the roller assembly, were the retainer is received on the pin 89 which extends entirely through the member 43 and is secured therein. The cover, being sock-like, has a smaller inside diameter than the outside diameter of the core segments. Therefore it must be slid on like a sock on a leg, with slight stretching so that, when secured at the ends, will be snug on all the segments throughout their circumference.

Figure 4:
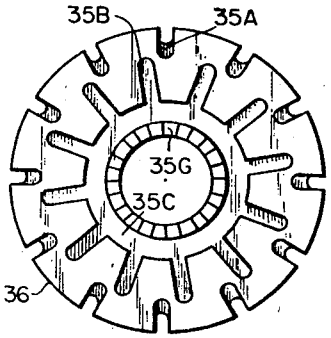
FIG. 4 is a view of the opposite face of one of the roller segments.
Figure 3:
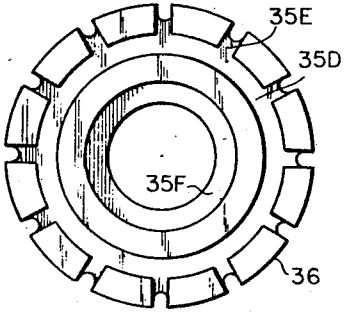
FIG. 3 is a view of one face of one of the roller segments.
Figure 6:
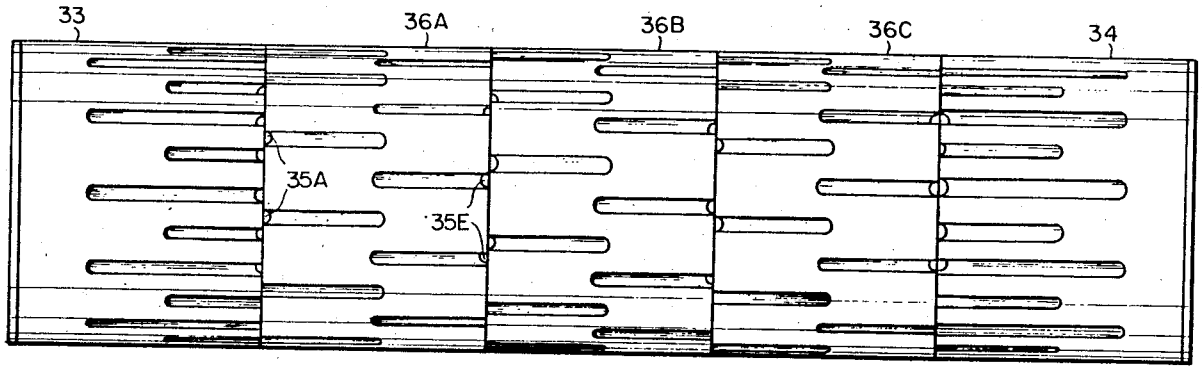
FIG. 6 is a view of the outside of part of the roller assembly, with the shaft and cover omitted.
Figure 7:
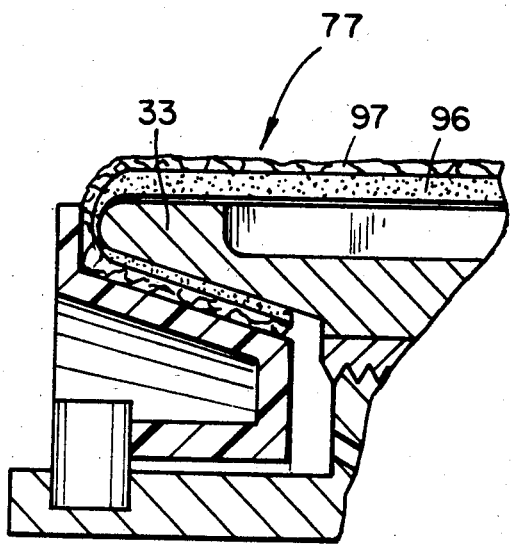
FIG. 7 is a fragmentary view of the roller assembly with a flocked foam cover.

As shown in FIGS. 3 and 4, the opposite faces of each of the intermediate segments 36 are different. Abutting faces of segments cooperate to provide controlled radial and circumferential flow of the paint from the interior of the segments to the outer surfaces thereof where it can then pass along the longitudinal slots such as shown in FIG. 6 where it is received through the back of a high nap textile roller cover 77. The roller nap material may be any typical high pile knitted fabric manufactured for paint rollers. It is typically knitted polyester backing 93 with a polyester, wool or nylon (or mixed) pile 94 of $\frac{1}{4}$ inch to $1\frac{1}{2}$ inch height. FIG. 7 shows a fragment of the roller with a flocked foam cover. It is a slip-on sock-like cover having an open cell or filter foam at 96 with flocking thereon at 97. It is secured to the core segments 33 and 34 by retainers as described above for the roller cover 77. Covers of other materials may be used in some applications.

The roller core of stacked segments features the use of relatively rigid moldable material for segments. This contributes to ease and economy of manufacture, (molded one-piece). Passages can be of any complexity required to achieve required baffling and good distribution. Passages easily open up for cleaning. The use of stacked segments facilitates standardization of components in rollers of different lengths by simply selecting a cover and tube 12 of desired length, and screwing together more or less segments as needed.

It is possible that, in production models, some efficienties can be achieved in construction. One example would be the possibility of avoiding the necessity of separate metal cores for the segments and, instead, injection molding them with integral external and internal threads. Thereby, instead of having a discrete core such as 40A, for example, with internal threads at one end and external threads at the other end, this would be replaced by the threads being an integral part of the same material as the grooved portion of the segment. Injection molding could employ either closed cell foam materials, or the segments could be made in two hollow shells, welded together. If foam materials are used for the segments, it is desirable that the type foam and processing be such as to avoid absorption of paint or other materials with which this roller assembly is to be used. If welded shells of non-foam material are used, it is importnat that the welds be non-leaking, in order to avoid entry of paint under pressure to the cavities in the shell assemblies, resulting increase of weight, unbalance, and other problems which would result. Such construction minimizes weight and provides low cost manufacture of a high performance roller.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A roller assembly for coating a wall or the like and comprising:

core means having a plurality of relatively rigid segments fastened together in a stack having a central aperture and a longitudinal axis, said segments having grooves on external surfaces thereof;

bearing means for mounting said segments rotatably to handle means for rotation on said handle means about an axis colinear with the said axis of said stack;

a replaceable permeable cover received on the stack and covering the stack sufficiently to receive all of the coating material which passes through said grooves to the outer margins of said segments; and at least two of said segments having screw thread means thereon threaded together to hold the segments together.

2. The roller assembly of claim 1 and further comprising:

at least one cover retainer mounted at one end of said stack and sandwiching one end margin of said cover between said retainer and an axis-facing wall of one of said segments at said end of said stack, to secure the cover to the stack.

3. The assembly of claim 2 and further comprising:

a second cover retainer mounted at the other end of said stack and sandwiching an opposite end margin of said cover between said second retainer and an axis-facing wall of another of said segments at the opposite end of said stack to further secure said cover to said stack.

4. The assembly of claim 1 wherein:

said cover is flexible and sock-like.

5. The roller assembly of claim 4 wherein:

said cover is snugly received on said stack and is a high nap fabric material.

6. The roller assembly of claim 4 wherein:

said cover is snugly received on said stack and is a flocked foam material.

7. The roller assembly of claim 1 wherein:

the thread means on one of said two segments are centered on said axis and are received in the screw thread means on the other of said two segments.

8. The roller assembly of claim 7 wherein:

end seal means are coupled to at least one of said segments at an end of said stack so that, when coating material is supplied to said central aperture of the stack, its departure through the ends of the stack will be inhibited and it will preferentially depart through said grooves in a controlled manner.

9. The roller assembly of claim 1 wherein:

said segments are generally cylindrical and at least some of said grooves are on outer cylindrical surfaces of said segments.

10. The roller assembly of claim 1 wherein:

said segments are generally cylindrical, and at least some of said grooves are on generally flat end faces of said segments.

11. A roller assembly for coating a wall or the like and comprising:

core means having a plurality of relatively rigid segments fastened together in a stack having a central aperture and a longitudinal axis, said segments having grooves on external surfaces thereof;

bearing means for mounting said segments rotatably to handle means for rotation on said handle means about an axis colinear with the said axis of said stack;

a replaceable permeable cover received on the stack and covering the stack sufficiently to receive all of the coating material which passes through said grooves to the outer margins of said segments;

said segments being generally cylindrical;

at least some of said grooves being on generally flat end faces of said segments; and some of said grooves on said end faces being arcuate and centered on said axis, and some of said grooves being radially extending with respect to said axis.

12. The roller assembly of claim 11 wherein:

said radially extending grooves are interrupted at location between said central aperture and said outer cylindrical surface of said segments.

13. The roller assembly of claim 12 wherein:

at least two of said segments are end segments, and at least one of said segments is an intermediate segment, said arcuate grooves on said intermediate segment being on one of said end faces thereof, and said radially extending grooves on said intermediate segment being on the other end face thereof.

14. The roller assembly of claim 12 wherein:

the material of said segments is solid polyurethane foam of ten pound per cubic foot density.

15. The roller assembly of claim 1 wherein:

said stack is relatively rigid.

16. The roller assembly of claim 15 wherein:

said segments are made of rigid foam material.

17. A roller assembly for coating a wall of the like with a coating material, and comprising:

core means having a plurality of relatively rigid segments fastened together in a stack having a central aperture and a longitudinal axis, said segments having grooves on external surfaces thereof;

bearing means for mounting said segments rotatably to handle means for rotation of said handle means about an axis colinear with said axis of said stack;

a replaceable permeable cover received on the stack and covering the stack sufficiently to receive all of the coating material which passes through said grooves to outer margins of said segments;

said stack being relatively rigid;

said segments being made of rigid foam material; and said foam material is closed cell foam.

18. The roller assembly of claim 17 wherein:

said foam material is polyurethane.

19. A painting roller, comprising:

a plurality of separate core segments;

fastening means, associated with each core segment, for releasably fastening adjacent core segments securely to each other to form a stack of said core segments, said stack having a central longitudinal axis;

a paint supply tube extending through said stack along said axis, said stack being rotatably mounted on said tube;

a handle, by which the painting roller can be manually manipulated, connected to said tube;

a chamber defined between said tube and said core segments, said chamber extending along said axis;

a plurality of apertures in a side wall of said tube, said apertures providing communication between said tube and said chamber;

said core segments having end faces with recessed grooves therein, abutting end faces of adjacent core segments having passageways therebetween formed by said grooves, said passageways extending from said chamber to outer peripheral surfaces of the core segments; and a replaceable permeable cover extending over said stack to receive paint from said tube via said apertures, said chamber and said passageways.

20. The painting roller of claim 19, wherein the outer peripheral surfaces of said core segments have longitudinal slots therein which communicate with said passageways for passage of paint from said passageways along said outer periheral surfaces.

21. The painting roller of claim 19, wherein some of said grooves are arcuate about said axis and some of said grooves extend outwardly with respect to said axis.

22. The painting roller of claim 19, wherein said fastening means cmprises a screw-threaded extension and a screw-threaded socket associated respectively with adjacent core segments whereby said stack is built up by screwing core segments together.

23. The painting roller of claim 19, wherein said plurality of core segments comprises two end segments and at least one intermediate segment, opposite ends of said intermediate segment being asymmetrical.

24. The painting roller of claim 23, wherein said intermediate segment has an internally screw-threaded socket at one end and an externally screw-threaded extension at the other end.

25. The painting roller of claim 23, wherein one end face of said intermediate segment has grooves therein extending radially with respect to said axis, and an opposite end face of said intermediate segment has an arcuate groove therein extending arcuately about said axis.

26. A roller assembly for applying paint, comprising:

a core comprising a plurality of rigid segments detachably fastened together to form a stack having a central aperture extending along a central longitudinal axis of the stack;

handle means for manually manipulating the roller assembly;

bearing means for rotatably mounting said stack on said handle means for rotation about said axis;

a permeable cover received over said stack for applying paint to a surface to be painted;

means for connecting said central aperture to a supply of paint;

grooves in end faces of said segments, the grooves in abutting end faces of adjacent segments forming passageways communicating from said central aperture to outer peripheral surfaces of said segments for supplying paint from said central aperture to said cover; and means, forming part of said passageways, for baffling flow of paint outwardly from said central aperture to said cover and for influencing distribution of paint to said outer peripheral surface, said passageways including said baffling means being opened up for cleaning when said segments are detached from each other.

27. The roller assembly of claim 26, wherein said connecting means comprises an apertured tube extending from said handle means through said central aperture.

28. The roller assembly of claim 26, wherein some of said grooves extend transversely to said axis, and some of said grooves extend radially to said axis.

29. The roller assembly of claim 28, wherein the radially extending grooves are interrupted at locations between said central aperture and said outer peripheral surfaces.

30. A roller assembly for applying coating material to a surface, comprising:

a core comprising a plurality of segments detachably fastened together to form a stack having a central aperture extending along a central longitudinal axis of the stack;

means for rotatably mounting said core for rotation about said axis;

a permeable cover disposed over said core for applying the coating material to the surface;

means for connecting, in use, said central aperture to a supply of the coating material;

means, associated with end faces of said segments, for forming passageways communicating from said central aperture to outer peripheral surfaces of said segments for supplying the coating material from said central aperture to said cover; and said means for forming passageways including arcuate grooves in said end faces, said arcuate grooves extending arcuately about said axis.

31. The roller assembly of claim 30, wherein said segments are detachably screw-threaded together.

32. The roller assembly of claim 30, wherein said means for forming passageways communicates with slots in said outer peripheral surfaces, and further comprising a handle by which the roller assembly can be manually manipulated, said rotatably mounting means rotatably mounting said core on said handle.

* * * * *